United States Patent [19]

Smith

[11] Patent Number: 4,778,005

[45] Date of Patent: Oct. 18, 1988

[54] BAFFLE SEAL FOR SHEEL AND TUBE HEAT EXCHANGERS

[75] Inventor: Hosea E. Smith, Baytown, Tex.

[73] Assignee: Exxon Research and Engineering Company, Florham Park, N.J.

[21] Appl. No.: 503,807

[22] Filed: Jun. 13, 1983

[51] Int. Cl.[4] ..... F28D 7/00

[52] U.S. Cl. ..... 165/160

[58] Field of Search ..... 165/160, 161

[56] References Cited

U.S. PATENT DOCUMENTS

| | | | |
|---|---|---|---|
| 1,355,980 | 10/1920 | Jones | 165/160 |
| 1,722,109 | 7/1927 | Potter | 165/160 |
| 1,803,034 | 4/1931 | Potter | 165/160 |
| 1,803,035 | 4/1931 | Potter | 165/161 |
| 1,955,006 | 4/1934 | Mateer et al. | 257/236 |
| 2,523,174 | 9/1950 | Worn | 165/161 |
| 2,550,725 | 5/1951 | Schultz | 138/87 |
| 2,900,173 | 8/1959 | Pickford | 257/239 |
| 3,958,630 | 5/1976 | Smith | 165/161 |
| 4,142,578 | 3/1979 | Smith | 165/81 |
| 4,215,745 | 8/1980 | Tuckmantal | 165/160 |

FOREIGN PATENT DOCUMENTS 2726317 5/1978 Fed. Rep. of Germany ..... 165/161

*Primary Examiner*—Abraham Hershkovitz
*Assistant Examiner*—John T. Kwon
*Attorney, Agent, or Firm*—Joseph J. Dvorak

[57] ABSTRACT

This invention relates to shell and tube heat exchangers and similar equipment and is particularly concerned with an improved arrangement for sealing the longitudinal edges of the pass baffle with the inner wall of the shell in such a manner as to prevent fluid leaks through that juncture which have the effect of bypassing the heat exchanger. The invention also relates to an improved tube bundle design wherein an aligned notch or indentation is provided in each of the tube bundle cross baffles adjacent the longitudinal edges of the pass baffle to yield a measure of protection for the edge of the pass baffle when the bundle is removed from the shell for maintenance purposes and to an optimized tube bundle configuration which may be readily reversed or rotated to extend its service life.

5 Claims, 2 Drawing Sheets

BAFFLE SEAL FOR SHEEL AND TUBE HEAT EXCHANGERS

BACKGROUND OF THE INVENTION

This invention relates to shell and tube that exchangers and similar equipment and is particularly concerned with an improved arrangement for sealing the longitudinal edges of the pass baffle with the inner wall of the shell in such a manner as to prevent fluid leaks through that juncture which have the effect of bypassing the heat exchanger. The invention also relates to an improved tube bundle design wherein an aligned notch or indentation is provided in each of the tube bundle cross baffles adjacent the longitudinal edges of the pass baffle to yield a measure of protection for the edge of the pass baffle when the bundle is removed from the shell for maintenance purposes and to an optimized tube bundle configuration which may be readily reversed or rotated to extend its service life.

Shell and tube heat exchangers are widely used for the indirect transfer of heat from one fluid to another. Typically, such an exchanger consists of an external shell having inlet and outlet ports for circulation of the shell-side fluid. An elongated bundle of tubes is positioned within the shell and provided with transverse baffles or cross baffles for directing the shell-side fluid back and forth across the tubes. The tubes are supported by one or more tube sheets, one of which is normally stationary, and if another is used, it may be of the floating type to accommodate changes in tube length due to thermal expansion. The tube bundle and shell may be arranged so that the tube-side fluid makes a single pass through the shell or instead makes two or more passes. In a single pass exchanger, the tube-side fluid is introduced into a head at one end of the shell and withdrawn from a second head at the other end. In a multiple pass unit, the exchanger will generally be provided with an internal head containing one or more baffles so that the tube-side fluid can be introduced into one portion of the head and withdrawn from the other portion. An internal head within which the tube-side fluid flows from one set of tubes into another will generally be located at the other end of the tube bundle. Those experienced in the art will readily appreciate that a wide variety of different combinations of shell and tube arrangements may be employed as the process requirements demand. However, in all such arrangements, it is generally desirable to have efficient and effective fluid seals between the shell and any pass baffles to prevent bypassing of inlet fluid around the pass baffle to the shell outlet connection, thus losing efficiency of the heat exchanger. Reference may be made to applicant's two prior patents, U.S. Pat. Nos. 3,958,630 and 4,142,578, for background in the heat-exchange field, and their disclosure is hereby incorporated herein by reference.

The present invention is particularly applicable to process heat exchangers with removable tube bundles and multiple shell-side passes such as more completely described in The Tubular Exchanger Manufacturer's Association (TEMA), Type F, Type G and Type H, such industry standards being herein incorporated by reference. While these general type industry standard heat exchangers offer very desirable process flexibility, they have not always proved effective in service because their pass baffle/shell seals are ineffective and much of the shell-side fluid can bypass the tube bundle, particularly after maintenance has been done to the tube bundle and the pass baffle seals damaged. In heat exchangers of this type, the higher pressure is always in the top of the shell and the lower pressure is at the bottom or outlet of the shell. The differential pressure across the pass baffle aids in the sealing of the pass baffle to the shell wall, but what has been experienced is that the commercially available seal designs, while initially being effective (having been assembled by the manufacturer with great care), are easily damaged in the field during maintenance operation on the tube bundle. Typically, such maintenance involves cleaning of scale from the tubes requiring that the bundle must be removed from the shell, lifted onto pallets, rolled over for cleaning, lifted again, and reinserted into the shell. At best, bundles are lifted with wide straps that pass around the lower periphery of each bundle and very readily damage the existing seals of such bundles installed by the manufacturer since they normally protrude beyond the periphery of the bundle and therefore are in contact with the straps during any lifting or rolling operations.

The problem of seals between the internal parts of heat exchangers has been addressed by numerous prior art patents; for example, U.S. Pat. No. 2,550,725 shows a heat exchanger employing elongated spring steel strips for locating and securing the pass baffle relative to the exchanger shell. Another U.S. Pat. No. 2,900,173 also contemplates an arcuate or curved seal strip located in a notch in the head wall to seal against a baffle plate. Other patents such as U.S. Pat. No. 1,955,006 show an arrangement for injecting a lubricant into the gap between a baffle plate and the shell wall of a heat exchanger. While all of these references recognize the desirability of sealing within heat exchangers, none of them relate to applicant's novel arrangement wherein a pair of elongated longitudinal support bars are welded to the interior wall of the shell to provide a receiving groove for the longitudinal edges of the pass baffle of the tube bundle. These exposed longitudinal edges of the pass baffle result from a plurality of recesses or notches made in the circular periphery of each of the bundles' cross baffles. Therefore, the pass baffle longitudinal edges are protected, so to speak, in the recess of each of the cross baffles so that upon bundle removal damage to the sealing edges of the pass baffle is less likely to occur. Furthermore, in applicant's arrangement the radial gap between the pass baffle longitudinal edge and the groove provided by the support bars is arranged to receive a "V" shaped spring seal member which, due to its normal resiliency, expands and seals the gap between the shell and the edge of the pass baffle. Furthermore, the orientation of each "V" spring seal is such that the "V" points downward toward the outlet side of the shell so that the higher pressure on the shell-side inlet is free to assist and expand the spring seal in the confining groove.

SUMMARY OF THE INVENTION

Accordingly, with the aforedescribed arrangement of "V" spring seal cooperative between the pass baffle edge and the support bar groove of the shell, the invention is effective to place the seal point inside the bundle periphery where it is not subject to abuse during handling, maintenance and reinsertion of the tube bundle within the shell. Applicant's arrangement also provides a totally protected auxiliary spring sealing device which is not subject to damage by normal bundle treatment. The double support bars welded to the inside of the shell are sufficiently stressed to be able to support the bundle weight at the seal point so that weight of the bundle actually aids in the sealing, unlike prior bundles which tended to have their weight supported off the bottom of the shell.

Accordingly, it is an object of this invention to provide an improved heat exchanger seal design which is not subject to damage during normal maintenance procedures.

A further object of the invention is to provide an improved tube bundle design for a heat exchanger wherein the sealing surfaces on the pass baffle of the bundle are recessed into the periphery of the bundle to minimize the likelihood of damage to the sealing edges of the pass baffle.

A still further object of the invention is to provide an internal spring seal which is enhanced by the fluid pressure differential within the heat exchanger which is both simple in design, rugged in construction and economical to manufacture.

These and other objects and advantages of the invention will become apparent and the invention will be fully understood from the following description and drawings in which.

It will be understood that the drawings illustrate merely a representative embodiment of the invention and that other embodiments are contemplated within the scope of the claims hereafter set forth.

DETAILED DESCRIPTION OF THE INVENTION

Figure 1:
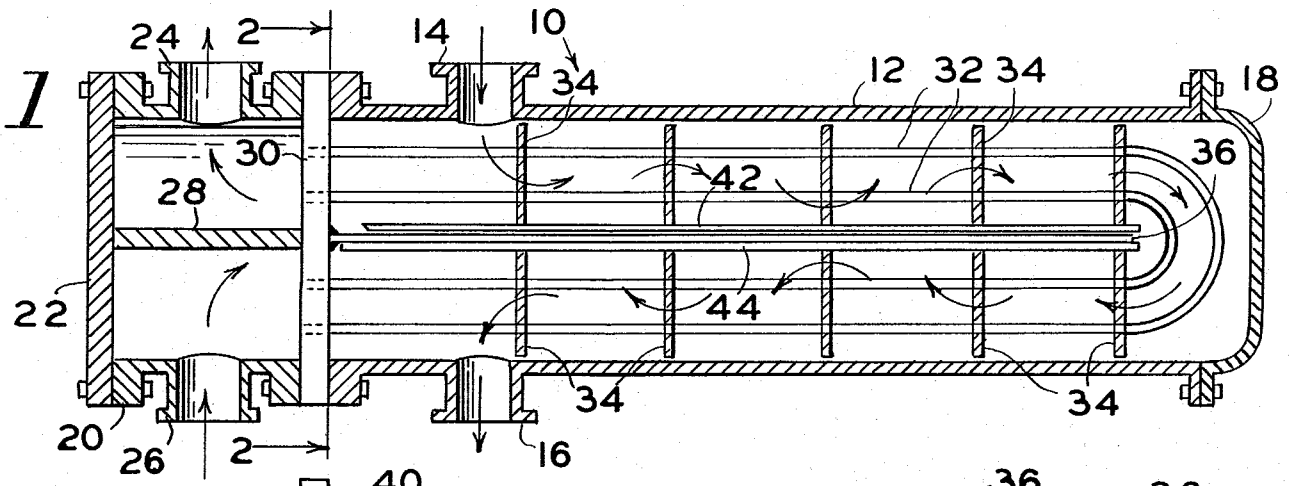
FIG. 1 is a horizontal cross-section of a heat exchanger in accordance with the invention.

The heat exchanger shown in FIG. 1 is a multiple pass shell and tube unit in which the tube-side fluid makes two passes through the unit and the shell-side fluid also makes two passes. The exchanger 10 includes an elongated, generally cylindrical outer shell 12 having a shell-side fluid inlet 14 and a shell-side fluid outlet 16. One end of the shell 12 is enclosed by a flanged head 18 while the opposite end is capped with a heat exchanger head generally indicated at 20. The head 20 includes a removable cover 22, an internal stop baffle or pass partition 28, as well as a tube-side inlet 26 and a tube-side outlet 24.

The tube bundle in the exchanger of FIG. 1 comprises a plurality of "U" shaped tubes 32 attached at their inlet and outlet ends to a tube sheet 30. The tube sheet 30 is securely clamped about its outer periphery between the flanges on the shell 12 and the exchanger head 20. Extending horizontally between the upper and lower passes of each "U" tube 32 is a horizontal pass baffle indicated at 36. The pass baffle 36 is securely welded at one end to the tube sheet 30 and includes rounded corners 38 at its opposite end for ease of insertion as will be explained hereafter. Secured to the upper and lower surfaces of the pass baffle 36 are a plurality of cross baffles 34 (see FIG. 2). Each of these cross baffles 34 include a circular outer peripheral edge generally conforming to the inner contour of the shell 12. As will be understood by those skilled in the art, the principal purpose of the cross baffles is to provide a circuitous path for the fluid flowing in the upper and lower passes through the tube bundle and to direct the fluid flowing therethrough across the tubes to optimize heat transfer therebetween. Additionally, the cross baffles 34 function to maintain the desired spacing and support for the adjacent tubes 32. Each of the cross baffles 34 includes a peripheral notched indentation 50 adjacent its juncture with the longitudinal edge of the pass baffle 36 so that a small edge portion of the pass baffle 36 protrudes into the cross baffle notches. (Refer to FIG. 2 cross-section.) This exposed longitudinal edge of pass baffle 36 is adapted to engage a pair of upper and lower support bars 42, 44, which are welded by fillet welds 46 to an inner wall of the shell 12. Normally, the weight of the tube bundle is transferred to the shell through the pass baffle resting on the lower support bar 44, as shown, and as such assists in effecting the seal between the upper and lower shell-side passes of the heat exchanger. Disposed along the longitudinal edge of the pass baffle 36 is an elongated "V" shaped spring seal strip 48 which is in compression when inserted in the gap between the respective parts. The location of the seal 48 is such that the bottom of the "V" points downwardly or toward the lower pressure outlet side of the shell-side fluid. Therefore, the pressure differential between the inlet side (i.e., the fluid above plate 36) and the fluid below plate 36, is such to expand the "V" seal to increase its sealing effectiveness.

Figure 5:
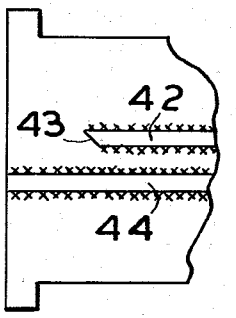
FIG. 5 is an enlarged detail view of the pass baffle support bars looking in the direction of the arrows along line 5—5 of FIG. 2.

Referring to FIG. 5, it may be seen that the upper support bar 42 includes a chamfered end portion 43 and that its length is slightly less than the lower support bar 44 at the point of bundle entry into the shell 12. Accordingly, when the head 20 of the exchanger is removed from the tube sheet 30 and the tube sheet 30 and its associated tube bundle slidably removed from the shell 12, the pass baffle 36 may be withdrawn to the left to a point where its innermost end is still supported by the lower bar 44 but no longer restrained by the upper bar 42, and accordingly may be lifted therefrom and removed completely without damage from the shell 12. Conversely, upon reinsertion of the tube bundle and tube sheet into the shell 12, the rounded corners 38 make insertion of the pass baffle easy and cooperate with the chamfered ends 43 of bar 42 to facilitate reassembly.

It should be noted that upon removal of the tube bundle from the shell 12 that its placement on a skid or suitable work surface will not damage the longitudinal edges of the pass baffle 36 since they are protected by the greater circular periphery of the cross baffles 34. This is so because the width of the pass baffle 36 is less than the diameter of the circular periphery of the cross baffles 34 and are thereby suitably protected in the aligned notched indentations of the cross baffles.

Figure 2:
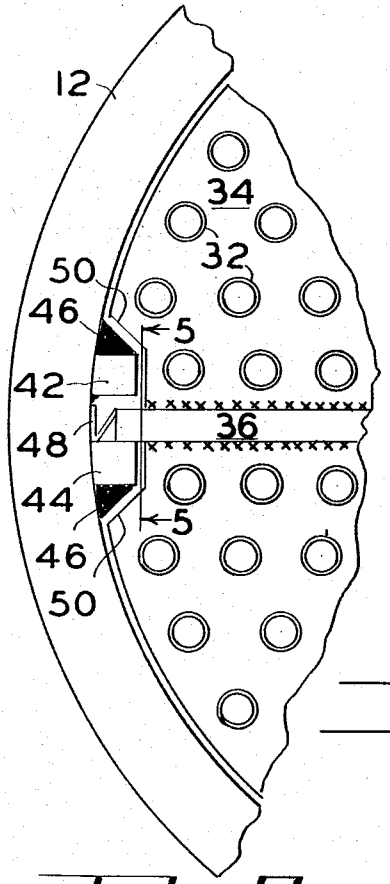
FIG. 2 is an enlarged partial cross-sectional view taken along line 2—2 of FIG. 1.
Figure 6:
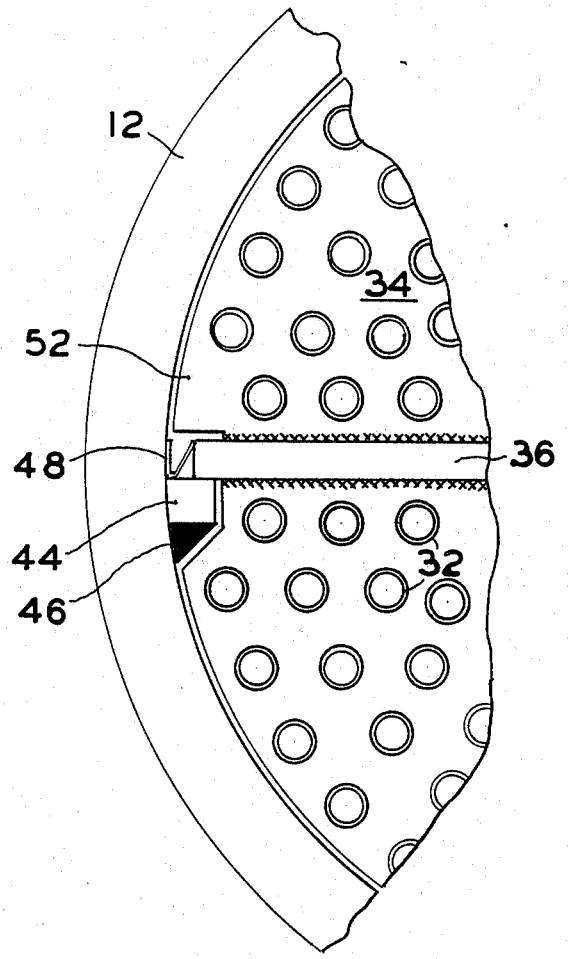
FIG. 6 shows an alternate enhancement of the invention wherein a single pass baffle guide bar is contemplated.

In the alternate embodiment shown in FIG. 6 which is a view similar to FIG. 2, elements having like function have been designated by the same numerals. However, in FIG. 6 there is provided but a single guide bar 44 which engages and supports the weight of the tube bundle along the longitudinal edges of the pass baffle 36. The cross section area of each cross baffle 34 is enlarged into the space otherwise taken up by the eliminated upper bar 42 of FIG. 2 by the extended cross baffle corner 52. With this arrangement it will be obvious that unlike the FIG. 1 embodiment, the tube sheet and bundle assembly will not be capable of being withdrawn and re-installed upon 180° rotation for tube life extension as is the case in the preferred FIG. 1 arrangement. Looking at the FIG. 1 arrangement in another way, it may be seen that the upper cut-out notch 50 in each of the cross baffles 34 would provide a by-pass channel down the length of the upper shell-side pass and reduce the heat exchanger efficiency if it were not for the "plugging" of such channel with the upper guide bar 42 and its associated fillet weld 46.

Figure 4:
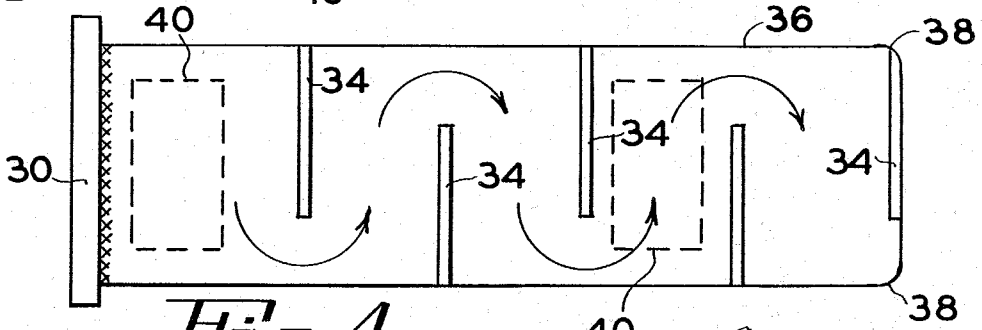
FIG. 4 is a top plan view of the tube sheet and pass baffle (without the tubes being illustrated) in accordance with the invention.
Figure 3:
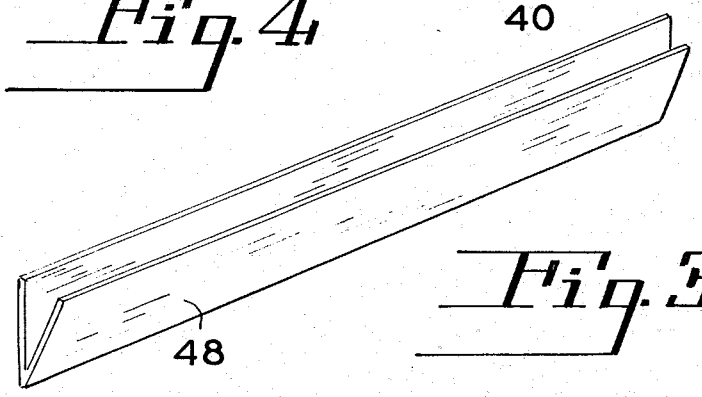
FIG. 3 is a perspective view of the spring seal in accordance with the invention.

Referring to FIG. 4, it should be noted that dotted sections 40 have been shown to illustrate contemplated alternate embodiments of the specific pass baffle plate arrangement. While it is only contemplated that cut-out portions 40 would appear in certain configurations of TEMA heat exchangers, applicant's showing thereof in FIG. 4 is done merely to illustrate that his invention contemplates the use of the improved seal and longitudinal edge protection technique in other forms of heat exchangers than the multiple pass shell side and tube-side exchanger illustrated.

While a specific embodiment of the invention has been shown and described in detail to illustrate the application of the invention principals, it will be understood that the invention may be embodied otherwise without departing from said principals.

What is claimed is:

1. A shell and tube heat exchanger comprising a tube bundle secured at one end to a tubesheet, an outer shell surrounding said tube bundle having a shell inlet and a shell outlet, a pair of diametrically opposed elongated support means affixed to the inner wall of said shell, a head member affixed to said shell adjacent said tubesheet having a tube side inlet and a tube side outlet, said tube bundle including: a longitudinally extending pass baffle for dividing shell side fluid into two passes between said shell inlet and shell outlet, a plurality of cross baffles affixed to said pass baffle at a plurality of stations along the length of said tube bundle each cross baffle having a generally circular peripheral edge and a pair of aligned peripheral notched indentations adjacent said pass baffle to expose an upper and lower surface of each longitudinal edge thereof for sliding engagement with said opposed elongated support means, and fluid seal means including a "V" shaped metal spring member extending for substantially the entire length of the longitudinal edges of said pass baffle in sealing engagement with the shell wall and the longitudinal edges of said pass baffle.

2. The combination of claim 1 wherein each said elongated support means comprises a pair of spaced bars with said fluid seal means disposed therebetween.

3. The combination of claim 2 wherein said spring member is disposed between the shell and the pass baffle edge with the bottom of the "V" pointed toward the shell outlet side of said pass baffle whereby the higher fluid pressure on the shell inlet side of the pass baffle will operate to expand the "V" and increase the sealing force.

4. The combination of claim 3 wherein the tube bundle comprises a plurality of "U" tubes.

5. The combination of claim 3 wherein the pass baffle includes one or more cut-out portions to bypass a portion of the shell side fluid from the shell inlet to the shell outlet.

* * * * *